United States Patent [19]

Daubner et al.

[11] Patent Number: 4,881,398

[45] Date of Patent: Nov. 21, 1989

[54] TRANSFER PRESS

[75] Inventors: Edmund Daubner, Goeppingen-Bartenbach; Gerald Mikusch, Goeppingen, both of Fed. Rep. of Germany

[73] Assignee: L. Schuler GmbH, Geoppingen, Fed. Rep. of Germany

[21] Appl. No.: 172,311

[22] Filed: Mar. 23, 1988

[30] Foreign Application Priority Data

Mar. 25, 1987 [DE] Fed. Rep. of Germany ..... 3709762

[51] Int. Cl.[4] ..... B21D 43/20

[52] U.S. Cl. ..... 72/419; 403/349; 72/405

[58] Field of Search ..... 72/405, 424, 419; 198/621; 100/193, 207, 215; 403/349, 348

[56] References Cited

U.S. PATENT DOCUMENTS 4,503,969 3/1985 Baba ..... 198/621
4,557,134 12/1985 Kuppinger ..... 72/405
4,713,961 12/1987 Hoehn et al. ..... 72/405

FOREIGN PATENT DOCUMENTS 3334021 6/1984 Fed. Rep. of Germany ..... 72/405

*Primary Examiner*—Daniel C. Crane
*Attorney, Agent, or Firm*—Barnes & Thornburg

[57] ABSTRACT

During a tool change, the template is to be moved dimensionally accurately into the idling stage of a transfer press and out of the same on support elements at the sliding table in the tool space of the transfer press. This requires a dimensionally accurate coupling. A gripping and holding device is provided in the idling stage for the insertion and retraction of a mounting bolt into a, respectively, out of a mounting bushing. The mounting bushing is thereby rotatably supported at the template and forms, on the one hand, a first bayonet-like connection by means of the mounting bolt, a guide groove machined into the same and a cylindrical pin engaging into this guide groove and, on the other, a second bayonet-like connection by means of a retaining plate, a cylindrical pin provided in the same and a mounting groove machined into the mounting bushing. These connections operate one after the other by rotation of the mounting bolt by means of an adjusting means. The arrangement can be used in a transfer press with an idling stage between press columns.

6 Claims, 4 Drawing Sheets

FIG.4
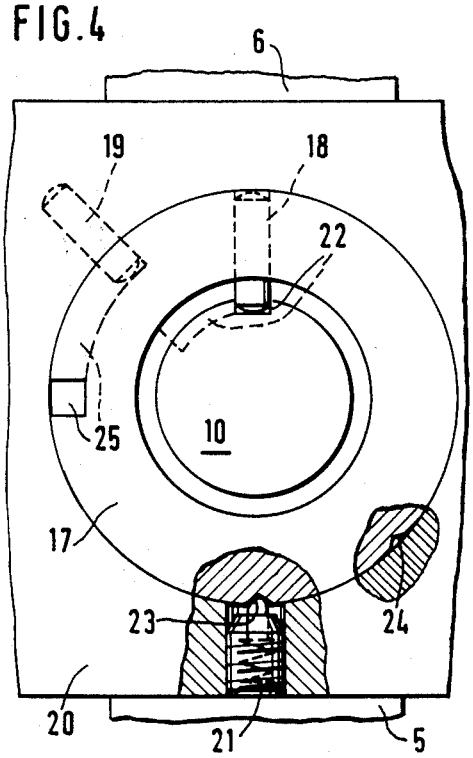
FIG.5
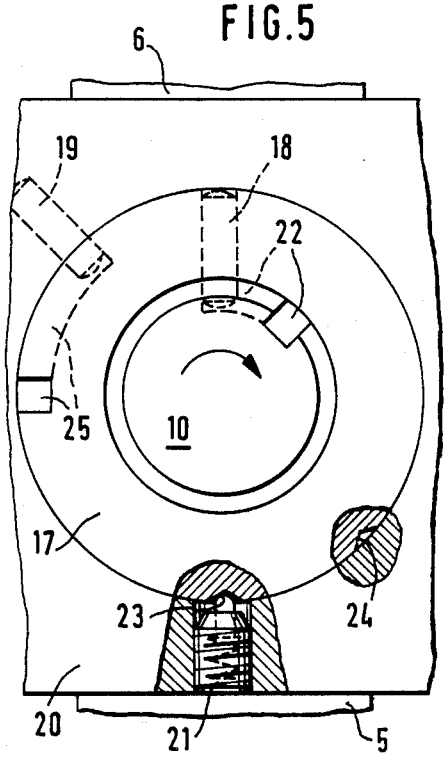
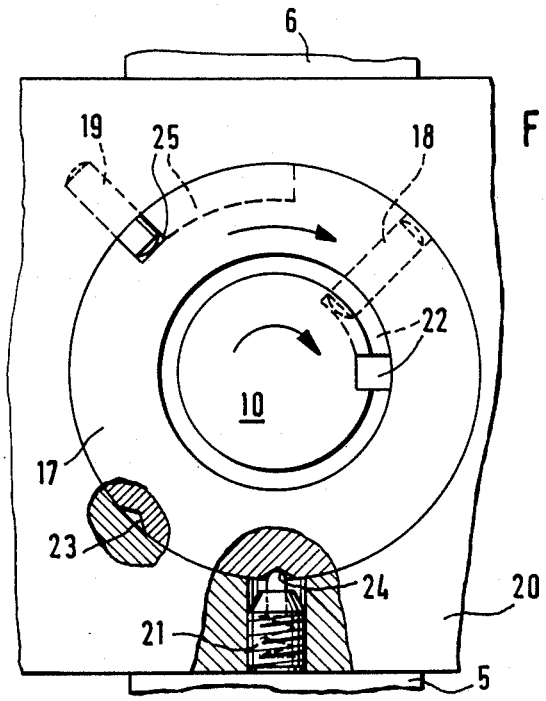
FIG.6

TRANSFER PRESS

BACKGROUND AND SUMMARY OF THE INVENTION

The present invention relates to an arrangement for the intermediate deposit of workpieces in idling stage areas of transfer presses, with gripping and holding devices arranged in the idling stage areas for templates guided into tool spaces of the transfer press together with the sliding tables by way of holding means, and with template supports provided at the gripping and holding devices which are adjustable horizontally toward and away from the sliding tables by way of a motorized drive.

In gang presses, large-part gang presses and similar transfer presses, in which larger workpieces are worked on in stages arranged one after the other, so-called idling stages are present between the press support columns. No deformation takes place in these idling stages. As a consequence of the fixedly resting transfer movement for the workpieces, the idling stages must include an intermediate deposit, whose top side corresponds to the shape of the bottom side of the workpiece in the support areas. With every tool change, intermediate deposits have to be installed which are matched to the new workpiece.

An arrangement for the intermediate deposit of workpieces in idling stages of transfer presses is shown and described in the DE-PS 33 34 021. The arrangement consists of a gripping and holding device arranged within the area of an idling stage. With the aid of toothed racks which are attached at the gripping and holding device, are movable in the transfer direction and are constructed as grippers, templates displaceable together with the sliding table can be seized and transferred into the area of the idling stage. The templates are seized by rotatable anchors at the grippers which for that purpose engage bayonet-like through openings in the template. During the exchange of the sliding tables, the templates are retained at the sliding tables by way of bolt-aperture guidances and holding magnets. This type of the suspension of the templates at the sliding tables is favorable as regards costs; however, it entails the danger of an inexperienced handling of the templates.

In contrast thereto, the object of the present invention resides in the accurate guidance of the template during the decoupling from the sliding table or tool, the dimensionally accurate placement of the template into the idling stage and the fittingly accurate attachment of the template at the sliding table or at the tool during the tool change as also the avoidance of the manual involvement of a person not familiar with the expert handling of the templates.

The underlying problems are solved according to the present invention in that the templates are provided with rotatably supported mounting bushings into which the mounting bolts are adapted to be inserted, in that the holding means are bored out for the mounting of mounting bushings and in that a first bayonet-like connection is provided between the mounting bushing and the mounting bolt and a second bayonet-like connection is provided between the holding means and the mounting bushing, whereby the bayonet-like connections are adapted to be activated one after the other in such a manner that the bayonet-like connection between the mounting bushing and the mounting bolt becomes effective prior in time to the bayonet-like connection between the holding means and the mounting bushing when the mounting bolt is guided into the mounting bushing for taking over the template.

Advantages of the present invention follow from the safe handling of the templates during tool change. The detachment of the template from the sliding table or from the tool takes place in the manner according to the present invention by a single rotary movement after moving the template support toward the sliding table, in the course of which the template is fixed at the grippers by the locking of the bayonet-like arrangement by means at the mounting bolt and at the mounting bushing and is detached from the sliding table, respectively, the tool, by the opening of the connection of the bayonet-like arrangement by means at the mounting bushing and at the holding means of the sliding table. The detachment from the sliding table takes place thereby only when the template has been coupled safely at the grippers. The docking of the template at the sliding table takes place in a reverse sequence also by only a single rotary movement for the coupling at the sliding table, respectively, at the tool and the decoupling from the gripper which takes place later in time. The accurately fitting components and the time-delayed sequence of the coupling/uncoupling enables a fully automatic change operation carried out by and monitored by the press control. The automatic undesired adjustment of the stopped coupling Position of the mounting bolt and of the mounting bushing is prevented. The multi-partite arrangement of the template enables the use of more light-weight materials.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein:

FIG. 4 is a partial elevational view, partly in cross section, indicating the position of the mounting bolt and of the mounting bushing during the movement of the gripper toward the template in the arrangement according to the present invention; FIG. 5 is a partial view, partly in cross section, similar to FIG. 4, and illustrating a first partial rotation of the mounting bolt in the mounting bushing; and FIG. 6 is a partial view, partly in cross section, similar to FIGS. 4 and 5, and illustrating the coupling condition after completed rotation of the mounting bolt in the mounting bushing.

DETAILED DESCRIPTION OF THE DRAWINGS

Figure 1:
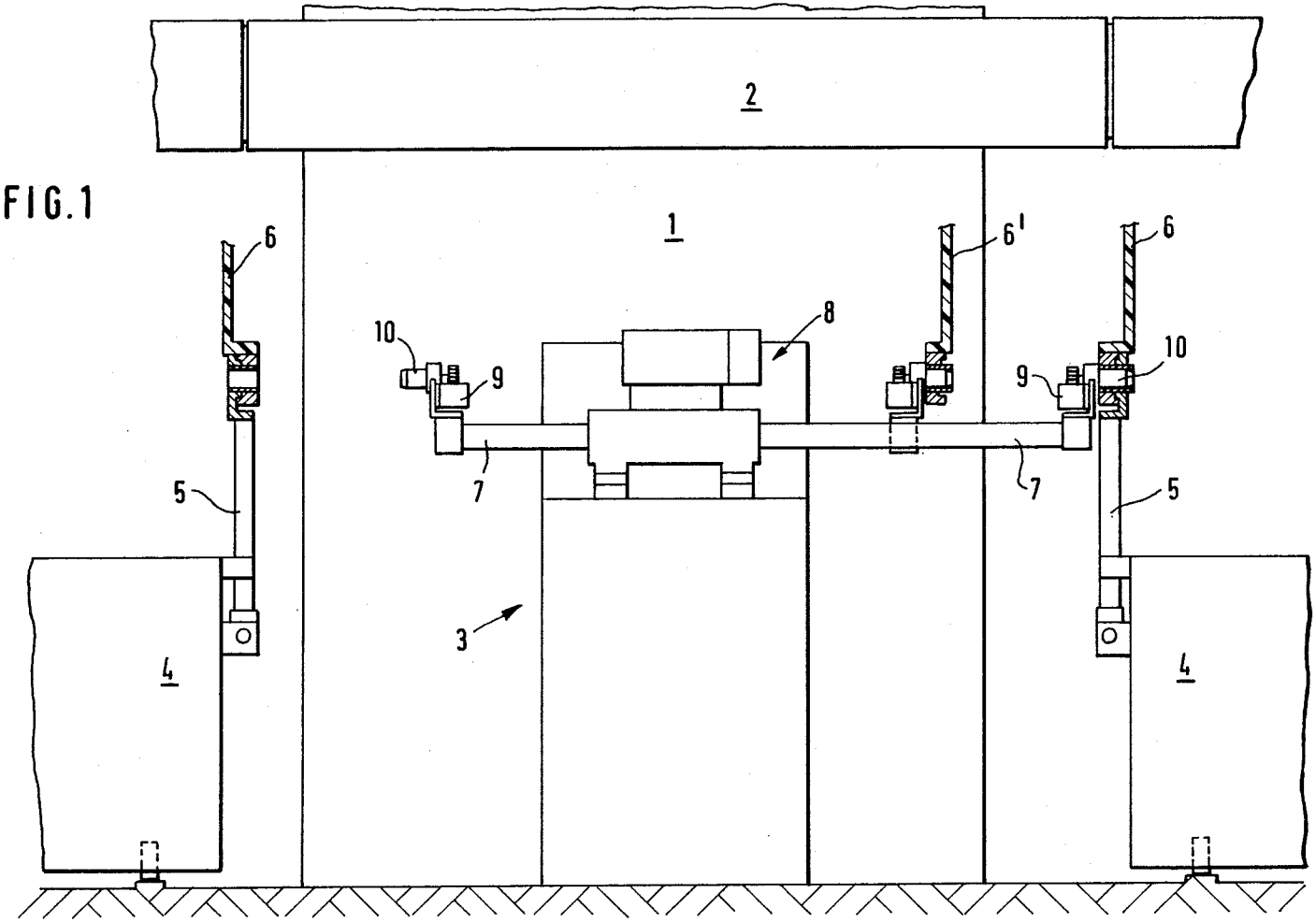
FIG. 1 is a schematic view of an idling stage within the area of the press columns of a transfer press in accordance with the present invention.

Referring now to the drawing wherein like reference numerals are used throughout the various views to designate like parts, and more particularly to FIG. 1, an idling stage area between press columns 1 of a transfer press is illustrated in this figure. The press column which is disposed in front is thereby omitted in the idling stage area for the better recognition of a gripping and holding device generally designated by reference numeral 3. The indicated transfer rails 2 serve for the transfer of workpieces between the working stages and idling stages. The gripping and holding device 3 includes a motorized drive 8 which may include hydraulically, pneumatically or electrically actuatable adjusting means, by means of which template carriers 7 are adapted to be moved out (extended) and moved in (retracted) preferably in the horizontal direction. In the illustrated embodiment, two template carriers 7 per template 6 disposed one behind the other in relation to the plane of the drawing are provided, of which the rearwardly disposed template carrier is covered off. The template carriers 7 carry at their extensible end parts adjusting means 9 of electrical, hydraulic or pneumatic type and mounting bolts 10. Sliding tables are adapted to be moved into the work tool spaces of the transfer press for the tool change. Support elements 5 for templates 6 are secured at the lateral parts of the sliding tables 4. The support position of the templates 6 in one of several possible idling stages is indicated by reference numeral 6'.

Figure 2:
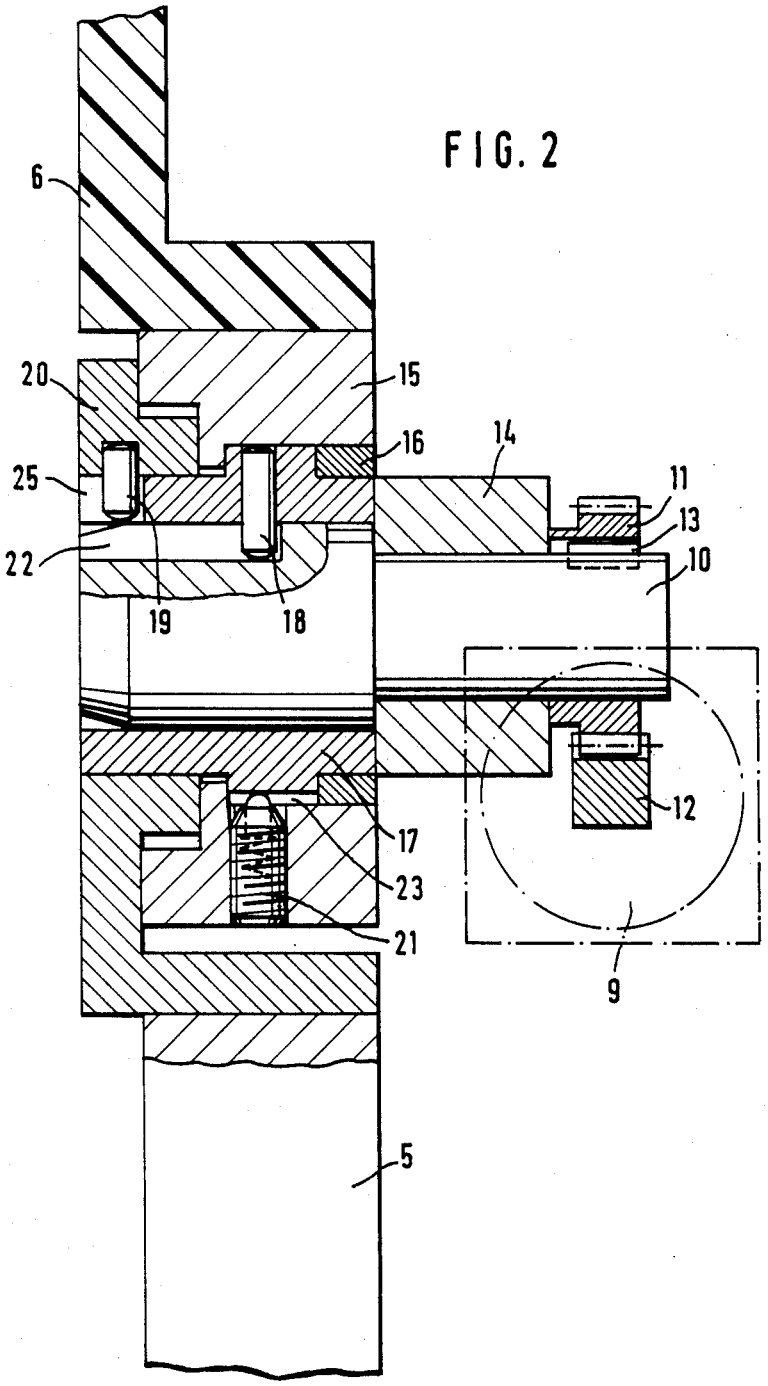
FIG. 2 is a partial cross-sectional view illustrating the coupling condition of the mounting bolt and mounting bushing prior to the rotation of the mounting bolt in the arrangement according to the present invention.
Figure 3:
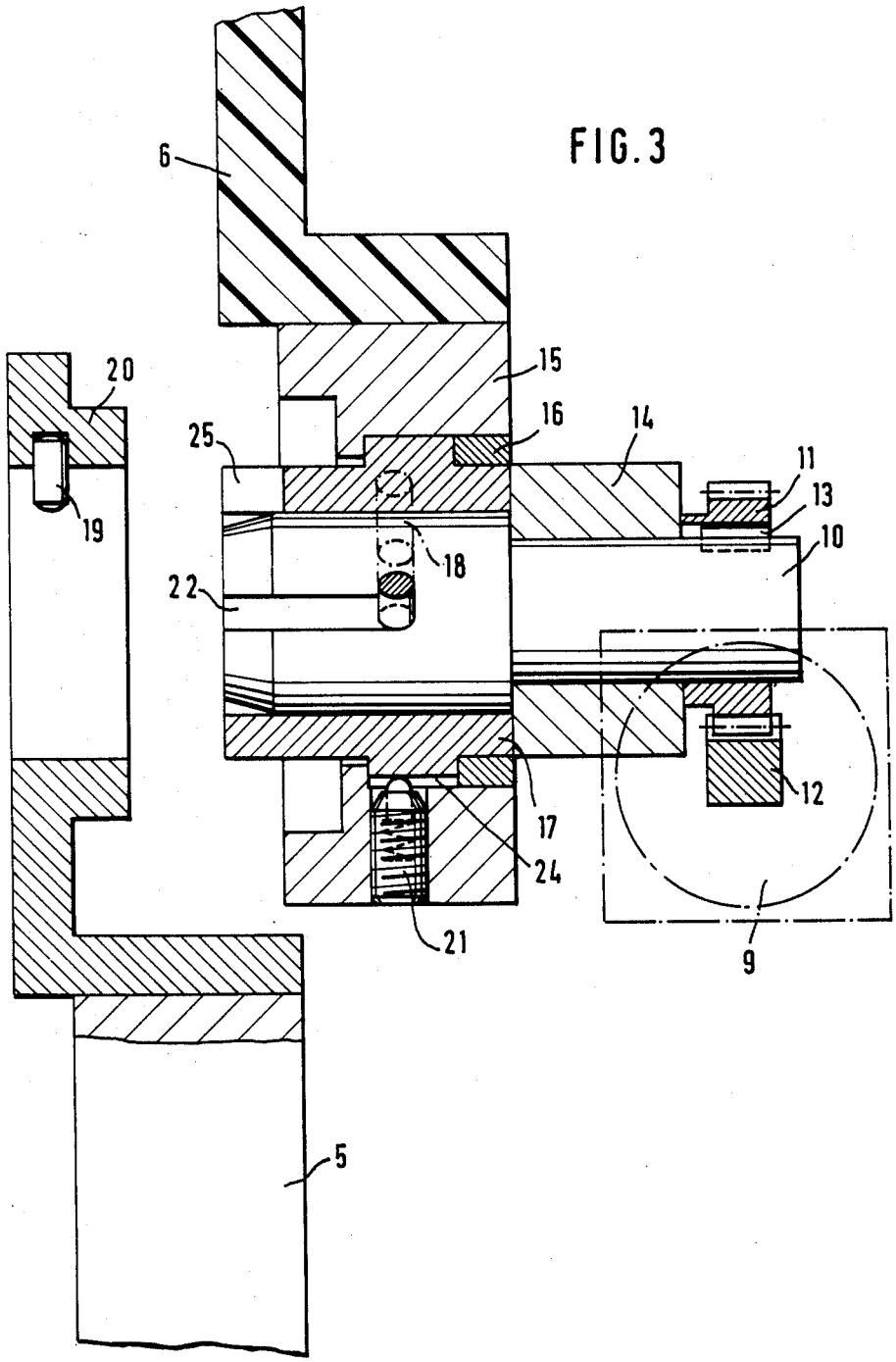
FIG. 3 is a cross-sectional view, similar to FIG. 2, illustrating the coupling condition during the movement of the template into the idling stage in an arrangement according to the present invention.

As can be seen from FIG. 2 and 3, each support element 5 terminates in the upward direction with a retaining plate 20. The retaining plate 20 can be constructed as transverse member and may extend over, for example, two coupling areas for the template 6. The retaining plate 20 is bored out in the coupling areas for receiving a mounting bushing 17 rotatably fixed at the template 6. A cylindrical pin 19 is fitted into the holding or retaining plate 20. The mounting bushing 17 includes within this area a portion of a mounting groove 25 which initially extends in the axial direction, starting from the side opposite the gripping and holding device 3, depending on the immersion depth of the mounting bushing 17 in the retaining plate 20. This axially extending portion of the guide groove 25 passes over into a portion extending at right angle thereto in the form of a circumferential groove, whose configuration can be seen from FIGS. 4 to 6. The mounting bushing 17 is rotatably inserted into a mounting carrier designated by reference numeral 15 with the assistance of an adjusting ring 16. The mounting bushing 17 includes an inwardly protruding cylindrical pin 18 which enters into a guide groove 22 in the mounting bolt 10 of the template carrier 7 (FIG. 1). The guide groove 22 in the mounting bolt 10 extends from the left end face thereof, as viewed in FIGS. 2 and 3, in the axial direction corresponding to the immersion depth of the mounting bolt 10 in the mounting bushing 17. The guide groove 22 passes over into a portion extending at right angle thereto in the form of a circumferential groove, whose configuration can be recognized more clearly from FIGS. 4 to 6. The mounting carrier 15 includes an arresting device 21 which engages in this case into an arresting groove 23 and prevents the mounting bushing in this position which corresponds to the coupling/decoupling position of mounting bolt 10 and mounting bushing 17, from a free rotation. A spacer ring is designated by reference numeral 14, against which is supported the mounting bushing 17. A spur gear 11 is mounted on the reduced end portion of the mounting bolt 10 by means of a fitting and adjusting spring 13, which spur gear is in operative engagement with a toothed rack 12. The toothed rack 12 may be the extended end part of a piston rod extended out of the adjusting means 9. In view of the drawing illustration in FIGS. 4 to 6, it should be noted that the bolt 19 illustrated in FIGS. 2 and 3 in the retaining plate 20 as well as the guide groove 25 in the mounting bushing 17 are shown offset by 45° in the plane of the drawing of FIGS. 2 and 3. The manufactured position of the means 19 and 25 along the circumference of the mounting bushing 17 is without influence to the function of the present invention.

FIG. 3 illustrates particularly clearly that the mounting bushing 17 remains at the template 6 during the detachment of the template 6 from the support element 5. The mounting bushing 17 has been rotated through 45° as a consequence of a rotation of the mounting bolt 10 by means of the adjusting means 9 and the toothed rack 12 through 90°. The arresting device 21 now engages in the arresting groove 24.

FIG. 4 illustrates the rotary position of the mounting bolt 10 and of the mounting bushing 17 during the insertion of the mounting bolt 10 into the mounting bushing 17, respectively, during the removal of the mounting bolt 10 out of the mounting bushing 17. The cylindrical pin 18 is thereby guided into the axially extending portion of the guide groove 22 within the mounting bolt 10. The cylindrical pin 19 is located at the end of the portion of the mounting groove 25 which extends circumferentially in the mounting bushing 17. The arresting device 21 engages into the arresting groove 23 for securing the position of the mounting bushing 17. During an initial rotation of the mounting bolt 10 by means of the adjusting means 9, toothed rack 12 and spur gear 13 (FIGS. 1 and 2) under the assumption that the mounting bolt 10 has been inserted into the mounting bushing 17 up to the abutment of the spacer ring 14 at the mounting bushing 17, the mounting bushing 17 is initially rotated along because the cylindrical pin 18 is in the portion of the guide groove 22 indicated in dash line which extends circumferentially in the mounting bolt 10. Upon abutment of the cylindrical pin 18 at the end of the guide groove 22 under further rotation of the mounting bolt 10, illustrated in FIG. 5, the mounting bushing 17 is rotated until the portion of the mounting groove 25 extending axially thereto is aligned with the cylindrical pin 19, illustrated in FIG. 6. The template 6 can be removed from the support element 5 and the retaining plate 20. The arresting device 21 can secure this position of the mounting bushing 17 by engagement in the arresting groove 24. FIGS. 4 to 6 thus illustrate the sequential movements which occur sequentially in time, of the two bayonet-like connections formed by the parts: mounting bolt 10, guide groove 22, cylindrical pin 18 and mounting bushing 17, on the one hand, and mounting bushing 17, mounting groove 25, cylindrical pin 19 and retaining plate 20, on the other.

The docking of the template 6 at the sliding table 4 takes place in nearly reverse sequence whereby one starts with the position of all parts illustrated in FIG. 6. During the rotation of the mounting bolt 10 in the direction opposite to that indicated by the arrow, the mounting bushing 17 initially remains in the position illustrated in FIG. 6 until the cylindrical pin 18, after rotation of the mounting bolt through 45°, abuts at the oppositely disposed end of the portion of the guide groove 22, i.e., is aligned with the axially extending part. Thereafter, the mounting bushing 17 is rotated along by the mounting bolt 10 through 45° so that the end of the portion of the mounting groove 5 extending circumferentially on the mounting bushing 17 abuts at the cylindrical pin 19. With the alignment of the cylindrical pin 18 with the axially extending portion of the guide groove 22 and with the abutment of the cylindrical pin 19 at the end of the portion of the mounting groove extending circumferentially in the mounting bushing 17, the template carrier 7 can be retracted from the sliding table 4.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for the intermediate deposit of workpieces in inoperative idling stage areas of transfer presses remote from active work stage areas of transfer presses, comprising gripping and holding devices arranged in the idling stage areas for template means moved into tool spaces of the transfer press with sliding table means movable between the idling stage areas and the work stage areas of transfer presses by way of retaining means, template carrier means arranged at the gripping and holding devices which are displaceable generally horizontally toward the sliding table means and away from the same by a motorized drive means associated with the template carrier means, rotatable mounting bolt means provided at the template carrier means and rotatable by way of an adjusting means, said rotatable bolt means cooperating with apertures in the template means in the manner of a bayonet connection, the template means being provided with rotatably supported mounting bushing means, into which the mounting bolt means are adapted to be inserted, the retaining means being bored out for receiving the mounting bushing means, a first bayonet-like connection means being provided between the mounting bushing means and the mounting bolt means, a second bayonet-like connection means being provided between the retaining means and the mounting bushing means, the bayonet-like connection means being operable to be activated one after the other in such a manner that the bayonet-like connection means between the mounting bushing means and the mounting bolt means becomes effective in time prior to the bayonet-like connection means between the retaining means and the mounting bushing means when the mounting bolt means has been guided into the mounting bushing means for taking over the template means.

2. An arrangement according to claim 1, wherein the first bayonet-like connection means is formed by a portion of a guide groove extending in the direction of the axis of the mounting bolt means, by a portion of the guide groove extending at substantially right angle thereto and opposite the rotation of the mounting bolt means during the coupling of the mounting bolt means at the mounting bushing means and by a first cylindrical pin inserted into the mounting bushing means, the second bayonet-like connection means being formed by a portion of a mounting groove extending in the direction of the axis of the mounting bushing means, by a portion of the last-mentioned mounting groove extending at substantially right angle thereto and with the rotation of the mounting bushing means during the decoupling of the mounting bushing means from the retaining means and by a second cylindrical pin provided in the retaining means, the respective portion of the grooves extending in the axial direction being accessible from the side opposite the gripping and holding device for the engagement of the cylindrical pins.

3. An arrangement according to claim 2, further comprising arresting means between the mounting bushing means and the template means for holding the mounting bushing means in at least the coupling-/decoupling position of the mounting bushing means and mounting bolt means.

4. An arrangement according to claim 3, wherein the template means is constructed multi-partite and includes a mounting carrier means, into which two mounting bushing means are rotatably inserted and in which the mounting bushing means are retained by way of an adjusting ring each.

5. An arrangement according to claim 1, further comprising arresting means between the mounting bushing means and the template means for holding the mounting bushing means in at least the coupling-/decoupling position of the mounting bushing means and mounting bolt means.

6. An arrangement according to claim 1, wherein the template means is constructed multi-partite and includes a mounting carrier means, into which two mounting bushing means are rotatably inserted and in which the mounting bushing means are retained by way of an adjusting ring each.

* * * * *